US007980399B2

(12) United States Patent
Colin

(10) Patent No.: US 7,980,399 B2
(45) Date of Patent: Jul. 19, 2011

(54) MODULAR DISPLAY RACK

(75) Inventor: Maria Alejandra Noble Colin, Del Magdalena Contreras (MX)

(73) Assignee: Sabritas, S. De R.L. De C.V., Colonia Bosques de las Lomas (MX)

( * ) Notice: Subject to any disclaimer, the term of this patent is extended or adjusted under 35 U.S.C. 154(b) by 192 days.

(21) Appl. No.: 12/267,697

(22) Filed: Nov. 10, 2008

(65) Prior Publication Data

US 2010/0116758 A1 May 13, 2010

(51) Int. Cl.
*A47F 1/04* (2006.01)

(52) U.S. Cl. ..... 211/59.2; 211/194; 206/509; 220/4.27

(58) Field of Classification Search ..... 211/59.2, 211/1, 194; 206/527, 509, 585; 220/4.26, 220/4.27; 312/271, 272, 305, 293.2, 326–328
See application file for complete search history.

(56) References Cited

U.S. PATENT DOCUMENTS 1,852,455 A * 4/1932 Friedman ..... 132/293
1,883,776 A * 10/1932 Forsyth ..... 312/271
2,677,483 A * 5/1954 Shaw ..... 222/556
2,916,141 A * 12/1959 Arnot ..... 206/386
3,548,524 A * 12/1970 Rohnow ..... 40/506
D246,978 S * 1/1978 Armstrong ..... D15/89
4,154,356 A * 5/1979 Schieve ..... 220/480
4,183,432 A * 1/1980 Lemaire ..... 206/0.82
4,681,220 A * 7/1987 Beneke ..... 206/315.11
4,962,860 A * 10/1990 Lehmann ..... 211/88.01
5,934,010 A * 8/1999 Blackburn ..... 43/57.1
5,947,292 A * 9/1999 Chelfi ..... 206/509
6,134,825 A * 10/2000 Moffett et al. ..... 43/57.1
D543,842 S * 6/2007 Jackson ..... D9/420
7,533,776 B2 * 5/2009 Nickerson ..... 211/94.01
2002/0040880 A1 * 4/2002 Vasudeva ..... 211/99
2009/0120939 A1 * 5/2009 Wang et al. ..... 220/361

* cited by examiner

*Primary Examiner* — Korie Chan
(74) *Attorney, Agent, or Firm* — Bobby W. Braxton; Colin P. Cahoon; Carstens & Cahoon, LLP

(57) ABSTRACT

A modular display rack and, more specifically, a display rack having a plurality of cylindrical bins oriented horizontally and stacked vertically. The cylindrical bins consist of a transparent half-pipe bottom with vertical dividers attached to two circular end caps. The circular end caps provide a hinge for a rotatable door and snap-to-fit features that allow the stacking of the bins vertically.

17 Claims, 9 Drawing Sheets

MODULAR DISPLAY RACK

BACKGROUND OF THE INVENTION

1. Technical Field

The present invention relates to a modular display rack and, more specifically, to a display rack having a plurality of cylindrical bins oriented horizontally and stacked vertically. The cylindrical bins consist of a transparent half-pipe bottom with vertical dividers attached to two circular end caps. The circular end caps provide a hinge for a rotatable door and snap-to-fit features that allow the stacking of the bins vertically.

2. Description of Related Art

Display bins used in retail locations for the display of consumer products, such as salty snacks, candy, crackers, and cookies, are common in the industry. Prior art displays include units built with wire shelving on metal frames, plastic rectangular bins, and vertical cardboard towers. The product is typically available for viewing and dispensing from the front of the display. Many prior art display units are loadable from either the front or the back, but rarely from both positions. Most prior art display units also do not provide a barrier to shoplifting while maintaining product visibility. Finally, many prior art display units lack modular flexibility and maintain a relatively fixed configuration.

A need exists, therefore, for a display rack that is modular in design, loadable from the front or rear, that allows for both visibility of the product and some barrier to shoplifting. Such display rack should be easy to assemble and construct and ergonomically intuitive in use.

SUMMARY OF THE INVENTION

In a preferred embodiment, the invention comprises at least two cylindrical display bins. Each cylindrical display bin comprises a half-pipe bottom attached at its ends to circular end caps. The circular end caps further provide for a hinge attaching point at their centers upon which a rotatable door is hinged. The half-pipe bottom further comprises at least one vertical divider. The rotatable door and the half-pipe bottom, in a preferred embodiment, are both transparent to allow for better product viewing.

In order to construct a display rack unit, at least two of the above-described cylindrical display bins are stacked vertically while the individual bins are oriented in a horizontal position. The bins call be interconnected by end caps that are integral to each other or by end caps that contain snap-to-fit features that hold the bins together in the stacked orientation. With the bins stacked vertically but each bin oriented horizontally, the rotatable doors in a closed position prohibit access to the half-pipe bottoms. Rotating the rotatable doors up allows access to the half-pipe bottoms so that a consumer can remove product therefrom. These cylindrical bins can further be mounted on a base and have a display header located at the top of the modular construction.

Applicants' invention is easy to construct and assemble, provides good product visibility, and with the rotatable door is a deterrent to shoplifting. The display rack when assembled can be loaded with product from either the front or the rear by simply rotating the rotatable door to allow an openings into the half-pipe bottom.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
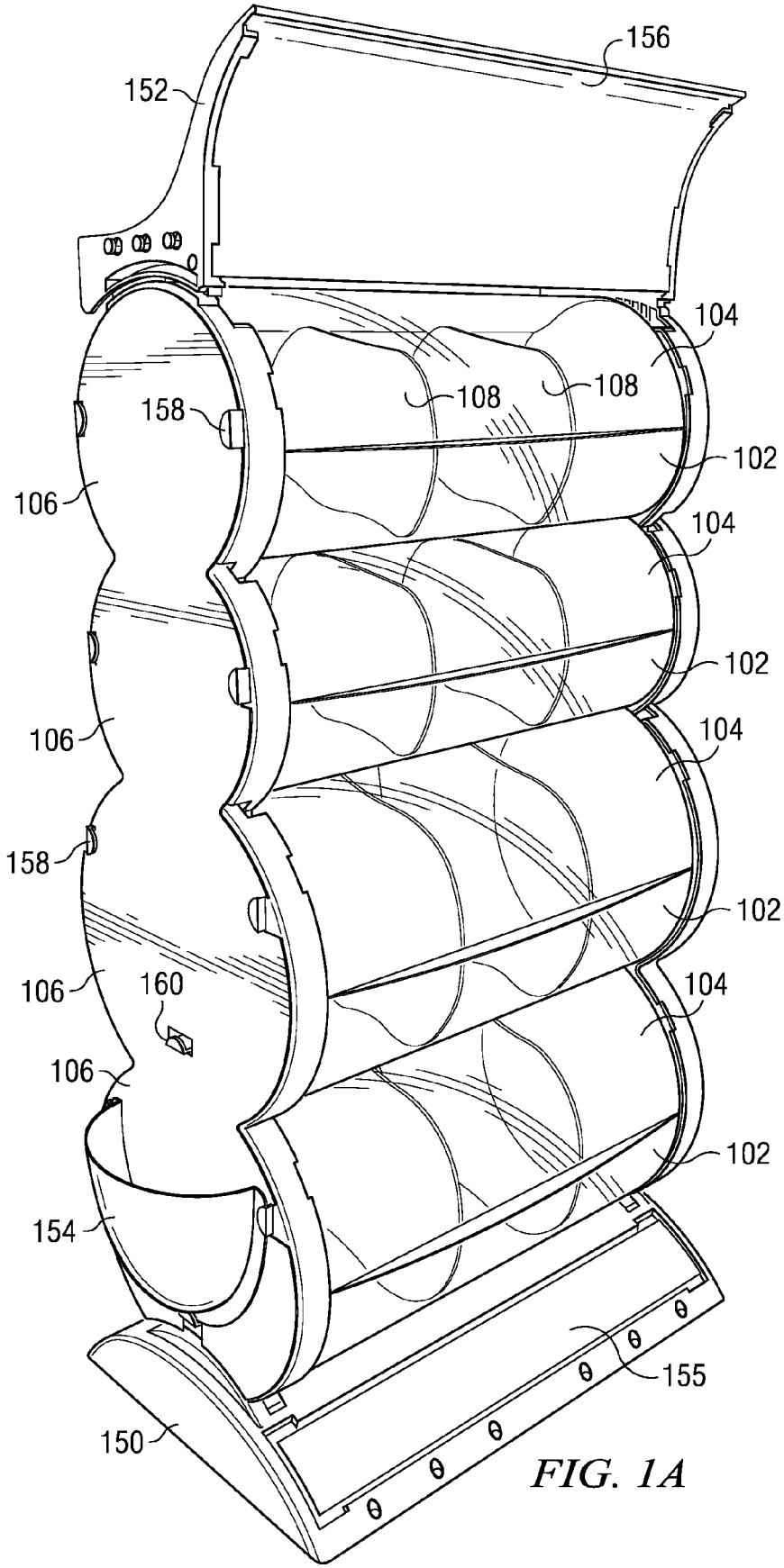
FIG. 1*a* is a front perspective view of one embodiment of Applicants' invention.

FIG. 1*a* is a perspective view of one embodiment of Applicants' invention showing a four-bin configuration with two small bins stacked on top of two larger bins. The components shown of this embodiment include the half-pipe bottom 102 associated with each bin, the rotatable door 104 associated with each bin, and the end caps 106 on the right side of each bin with the end caps 106 on the left side mostly obscured by the view. The basic construction of each bin of Applicants' invention consists of at least these three elements, the half-pipe bottom 102, the rotatable door 104, and the vertically-oriented end caps 106, one on either end of the half-pipe bottoms 102. In addition, Applicants' invention in one embodiment has at least one, and as shown in FIG. 1*a* preferably two, vertical dividers 108 in each of the bins. These vertical dividers 108 are, in one embodiment, integral with the half-pipe bottoms 102. In a preferred embodiment, the half-pipe bottom 102, rotatable door 104, and vertical dividers 108 are all constructed from a clear or transparent plastic such as Polystyrene Crystal (PS), so that product placed in the bin is clearly visible.

Also shown in FIG. 1*a* are a stand or base 150 and a display header 152 for graphics. The configuration of the base 150 and the display header 152 can vary considerably. For example, the base 150 can comprise the semi-circular design shown in FIG. 1*a* or can consist of a foot stand type arrangement. Thus, the base 150 illustrated in FIG. 1*a* and elsewhere in this application is an example of one of any number of base or stand configurations that can be used to support the vertically stacked horizontal bins of Applicants' invention. Further, any number of configurations of a display header 152 can also be used with Applicants' invention. In fact, the display header is optional to any one of Applicants' embodiments discussed herein.

Another optional feature shown in FIG. 1*s* is a side pocket 154 which is shown as mounted to the exterior of the bottom right end cap 106. Applicants' invention can incorporate as many as two side pockets 154 for every bin used for a particular configuration. However, the side pockets 154 are optional to all of Applicants' embodiments.

In a preferred embodiment, the components other than the half-pipe bottoms 102, rotatable doors 104, and vertical dividers 108 are all opaque. Specifically with regard to the embodiment illustrated in FIG. 1*a*, the circular end caps 106, base 150, header 152, and side pocket 154 are all opaque. These opaque components are, in a preferred embodiment, constructed of Polypropylene (PP). In an alternative embodiment, any one or all of the end caps 106, base 150, header 152, and side pockets 154 can also be constructed of a transparent or clear material.

Other features that are shown in Figure la include a slide-in guide 155 on the base 150 for the addition of graphics material, as well as a slide-in guide 156 in the header 152 for the same purpose. These slide-in guides 154, 156 allow for the quick installation and removal of printed graphic material on, for example, plastic or cardboard stock. Also shown are a plurality of attachment points 158, 160, which can be used for the installation of vertical graphics on the end caps 106, as well as the installation of side pockets 154 and hooks (not shown). The base 150 can also incorporate locking elements that allow for interlocking two or more displays in horizontal series so that they can operate as an integral unit.

Figure 1B:
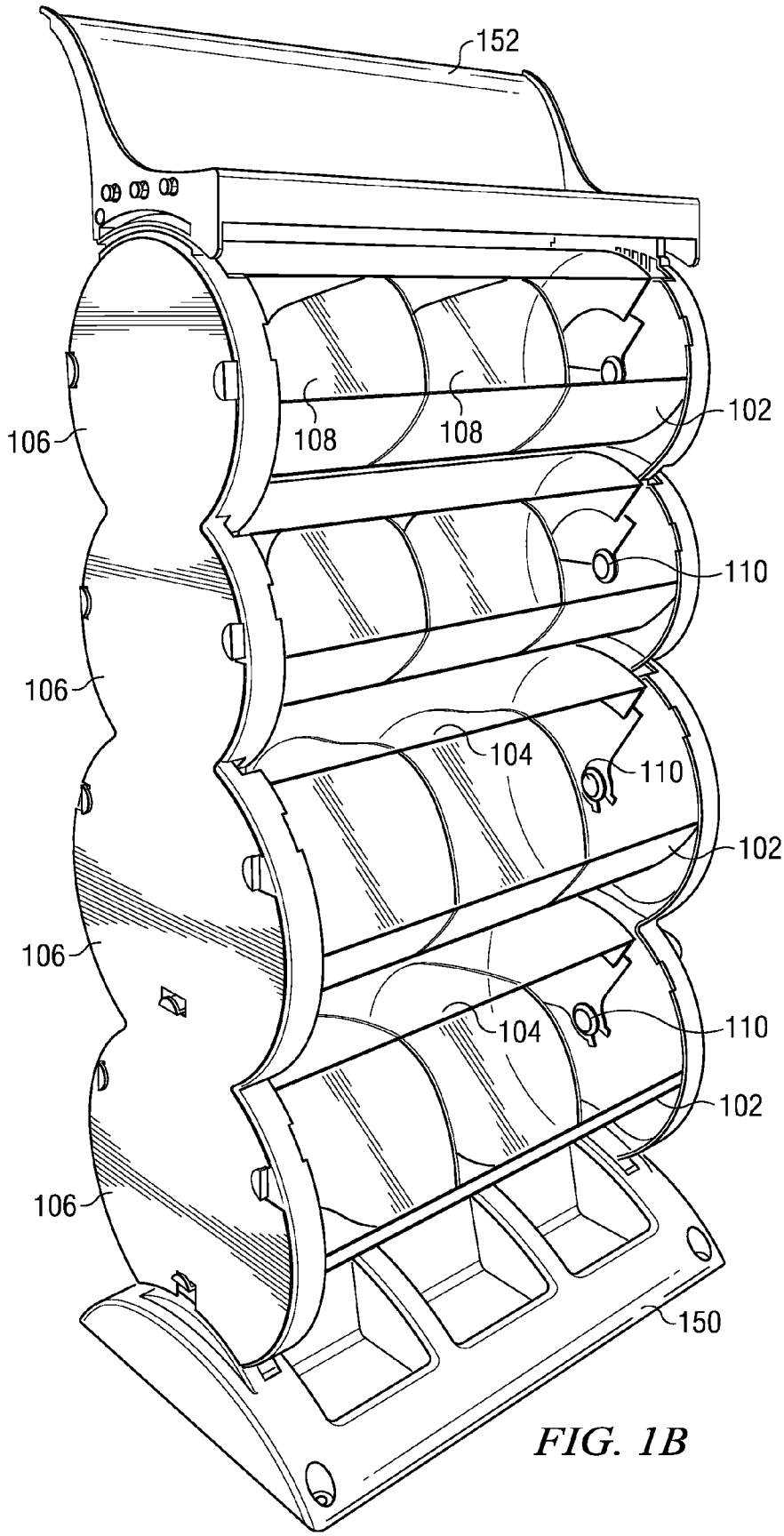
FIG. 1*b* is a rear perspective view of the embodiment of Applicants' invention show in FIG. 1*a;*

Referring to FIG. 1*b*, many of the components illustrated in FIG. 1*a* are illustrated by this rear perspective view. Now visible in FIG. 1*b* are the end caps 106 that were obscured by the front view shown in FIG. 1*a*. Also shown in FIG. 1*b* are the base 150 and header 152. It can be seen from the embodiment shown in FIGS. 1*a* and 1*b* that the rotatable door 104 is of such arc-width that the door when positioned to close the front of each bin (as shown in FIG. 1*a*) reveals an opening on each bin on the back side of the display (as shown in FIG. 1*b*). The rotatable door 104 in a preferred embodiment has the same approximate radius to its curved shape as that of the bottom 102 to which it is associated thus giving each bin in one embodiment a cylindrical appearance.

Also shown in FIG. 1*b* is a hinge post 110 located in the center of each side panel 106. This hinge post 110 operates as a hinge point for the rotatable door 104 as will be described in more detail with reference to FIG. 2. The hinge post 110 would be visible from the front perspective view of FIG. 1*a* through the transparent rotatable door, but is left out of this illustration for the sake of simplicity.

Figure 2:
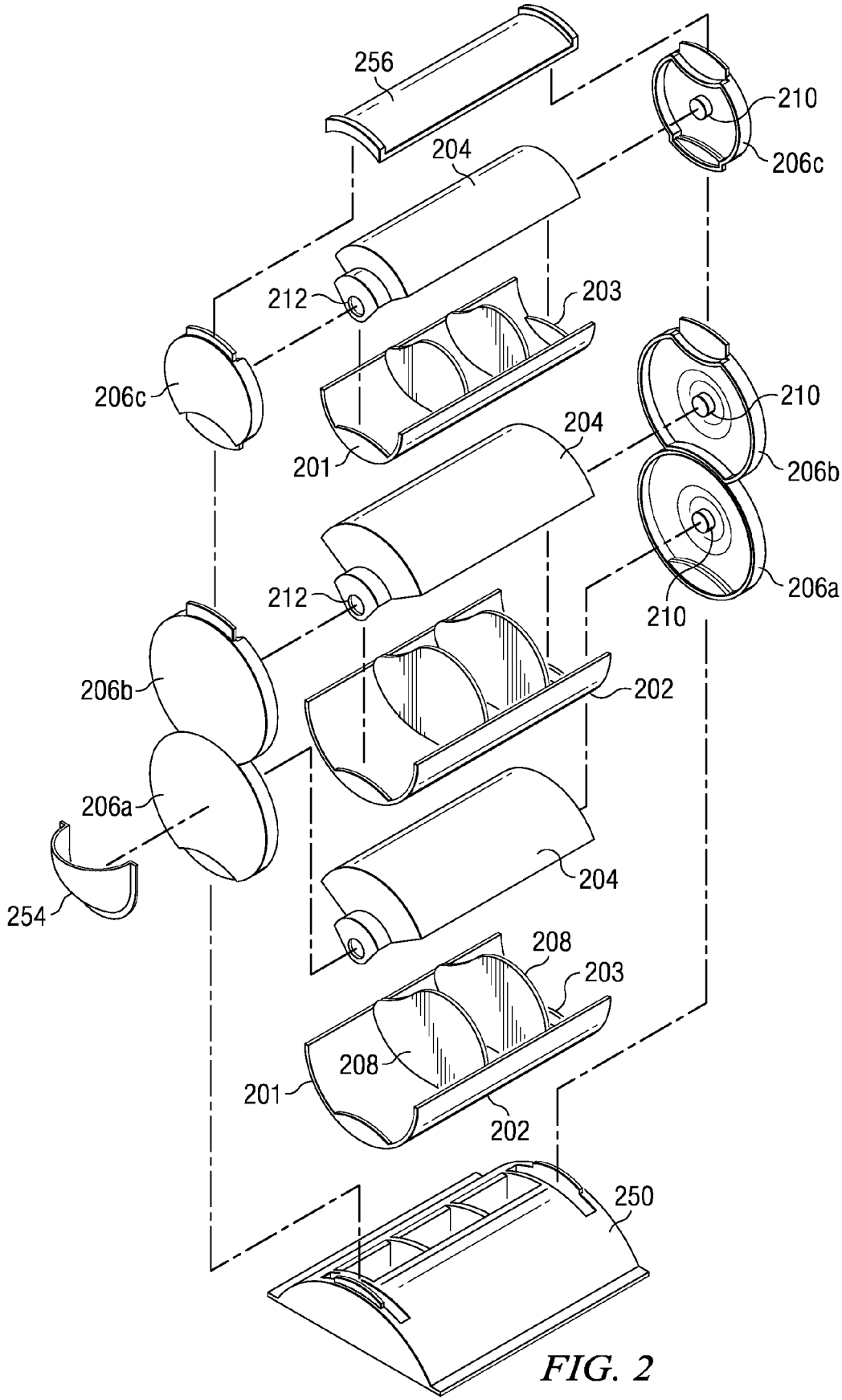
FIG. 2 is an assembly diagram showing the relationship of various individual components in one embodiment of Applicants' invention.

FIG. 2 is an assembly diagram showing the relationship of various components of Applicants' invention in an embodiment that incorporates one small bin stacked on top of two large bins mounted to a semi-circular base 250, and further shows two end caps 206*a*, 206*b* in an integral arrangement. Referring to the end caps 206*a*, 206*b*, 206*c*, it should be understood that Applicants' invention can use either individual stand-alone end caps 206*c* that are designed to mechanically mate with other end caps, or end caps 206*a*, 206*b* that are integral to each other. In other words, end caps 206*a*, 206*b* that are integral to each other are manufactured as a single piece as opposed to being mechanically mated or connected with an adjoining end cap 206*c*. In a preferred embodiment, it is anticipated that Applicants' invention will usually comprise at least two horizontal bins stacked vertically on top of each other. This being the case, a preferred embodiment uses two integral end caps 206*a*, 206*b* as the basic building block for most of Applicants' embodiments of the display. However, alternative embodiments use stand-alone end caps 206*c* exclusively. A further alternative embodiment uses integral end caps 206*a*, 206*b* that may number three or more end caps in a vertical yet integral arrangement.

It can also be seen that the half-pipe bottom 202 can be manufactured with at least one, and preferably two, vertical dividers 208. Applicants' invention can comprise more than two dividers 208, numbering as many as is required to divide the storage space of each bin. In a preferred embodiment, the dividers 208 are parallel to the end caps 206*a*, 206*b*, 206*c* and extend above the horizontal edges of the half-pipe bottom 202. The vertical divider 208 can either be integral to the half-pipe bottom 202 or the half-pipe bottom 202 can be manufactured with a plurality of receiving slots (not shown) in which individual vertical dividers 208 can be slotted for attachment to the half-pipe bottom 202.

The half-pipe bottoms 202 are mated at each end 201, 203 to a respective end cap 206*a*, 206*b*, 206*c*. This mating in a preferred embodiment involves a snap-to-fit arrangement between the ends 201, 203 of the half-pipe bottom 202 and a bottom portion of the end caps 206*a*, 206*b*, 206*c*. The half-pipe bottoms call also have air vents (not shown) to avoid dust accumulation within the bin.

At the center of each end cap 206*a*, 206*b*, 206*c* is shown the hinge post 210. In a preferred embodiment, each rotatable door 204 comprises a hinge consisting of a circular opening 212 that fits over the hinge post 210. This allows the rotatable door 204 to rotate into a position that can allow access alternatively to either the front or the back of each bin. When the rotatable door 204 is closed in the front of the display, an opening allowing restocking of the bin from the rear of the display is exposed.

It should also be understood that the half-pipe bottom 202 can be canted slightly when installed on the end caps 206*a*, 206*b*, 206*c* such that the rear horizontal edge of the half-pipe bottom 202 is slightly elevated above the front horizontal edge of the half-pipe bottom 202. This slightly canted arrangement pushes product forward and allows for easier removal of the product from the bin when the rotatable door 204 is rotated back to expose the bin from the front of the display. In an alternative embodiment the half-pipe bottom 202 is constructed with a concave rear area that also serves to push the product to the front of the bin. This design is evident from the shape of the bottom of the vertical dividers 108 shown in FIG. 1A.

Also shown in FIG. 2 is an optional side pocket 254. A further feature shown is a header mounting cap 256 used to cap off the three-bin arrangement and provide an attachment point for the optional header, which is not shown in FIG. 2.

Figure 3A:
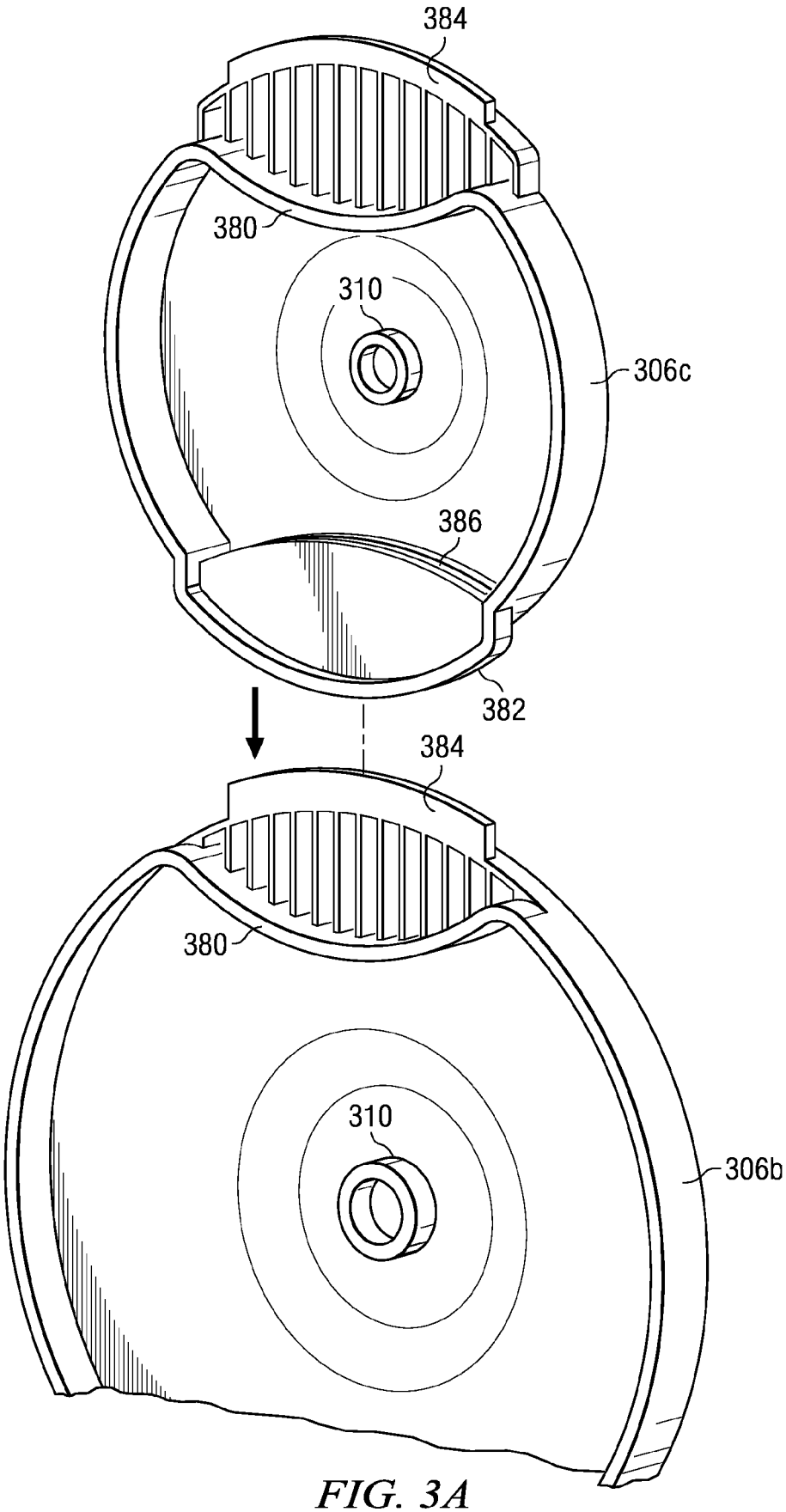
FIG. 3*a* illustrates the snap-to-fit connection feature of the circular end caps of one embodiment of Applicants' invention prior to mating.

FIG. 3*a* illustrates the mating or connecting features of two end caps 306*b*, 306*c* of one embodiment of Applicants' invention. The hinge post 310 is shown in the center of each of the end caps 306*b*, 306*c*, but will be described in more detail with reference to FIG. 4.

In a preferred embodiment of Applicants' invention, the top portion of the top end cap 306*b* of an integral arrangement of end caps (the end cap(s) below it are not shown), as well as the top portion of an) stand-alone end caps 306*c*, will both have an inner concave shelf 380 for receiving an inner convex rail 382 found on the bottom of a stand-alone end cap 306*c*. The inner convex rail 382 mates with and rests upon the concave shelf 380 when the end caps 306*b*, 306*c* are mated by moving them towards each as illustrated by the arrow in FIG. 3*a*. The stand-alone end cap 306*c* also has a receiving slot 386 for receiving an outer convex rail 384 from the end cap 306*b* to which the stand-alone end cap 306*c* is being mated. In one embodiment the outer convex rail 384 comprises at least one, and preferably two, convex ridges (not shown) running along the vertical inside face of the outer convex rail 384. These convex ridges have the same arc as the receiving slot 386 and act as snap-to-fit features when the outer convex rail 384 is inserted in the receiving slot 386.

It should be understood from the illustration shown in FIG. 3*a* that any number of stand-alone end caps 306*c* can be mated in the vertical arrangement by use of the inner convex rail 382, receiving slot 386, concave shelf 380, and outer convex rail 384 arrangement. These attaching means provide for quick assembly of the various horizontal bins and flexibility to reconfigure the bins to match the desired embodiments, such as the various embodiments that will be described with reference to FIGS. 5*a*, 5*b*, and 5*c*.

Figure 3B:
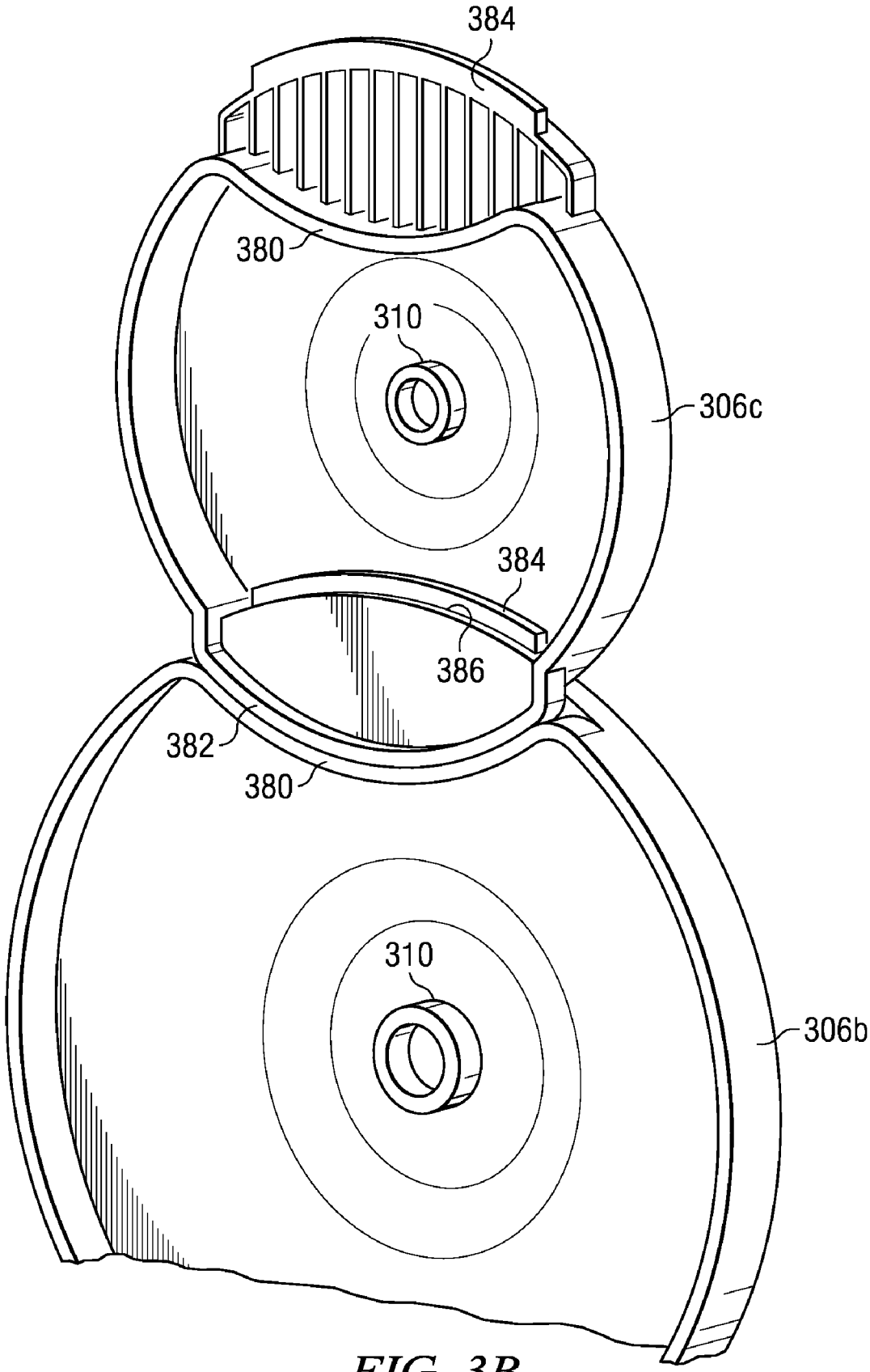
FIG. 3*b* illustrates the end caps of one embodiment of Applicants' invention in a mated configuration.

Referring to FIG. 3*b*, the lower end cap 306*b* is shown mated or connected with, in a mechanical fit, the upper end cap 306*c*. The inner convex rail 384 from the lower end cap 306*b* is shown protruding above the slot 386 of the upper end cap 306*c*. Further, the inner convex rail 382 from the upper end cap 306*c* is shown nested with and resting upon the concave shelf 380 of the lower end cap 306*b*. Also again illustrated are the hinge posts 310.

Figure 4:
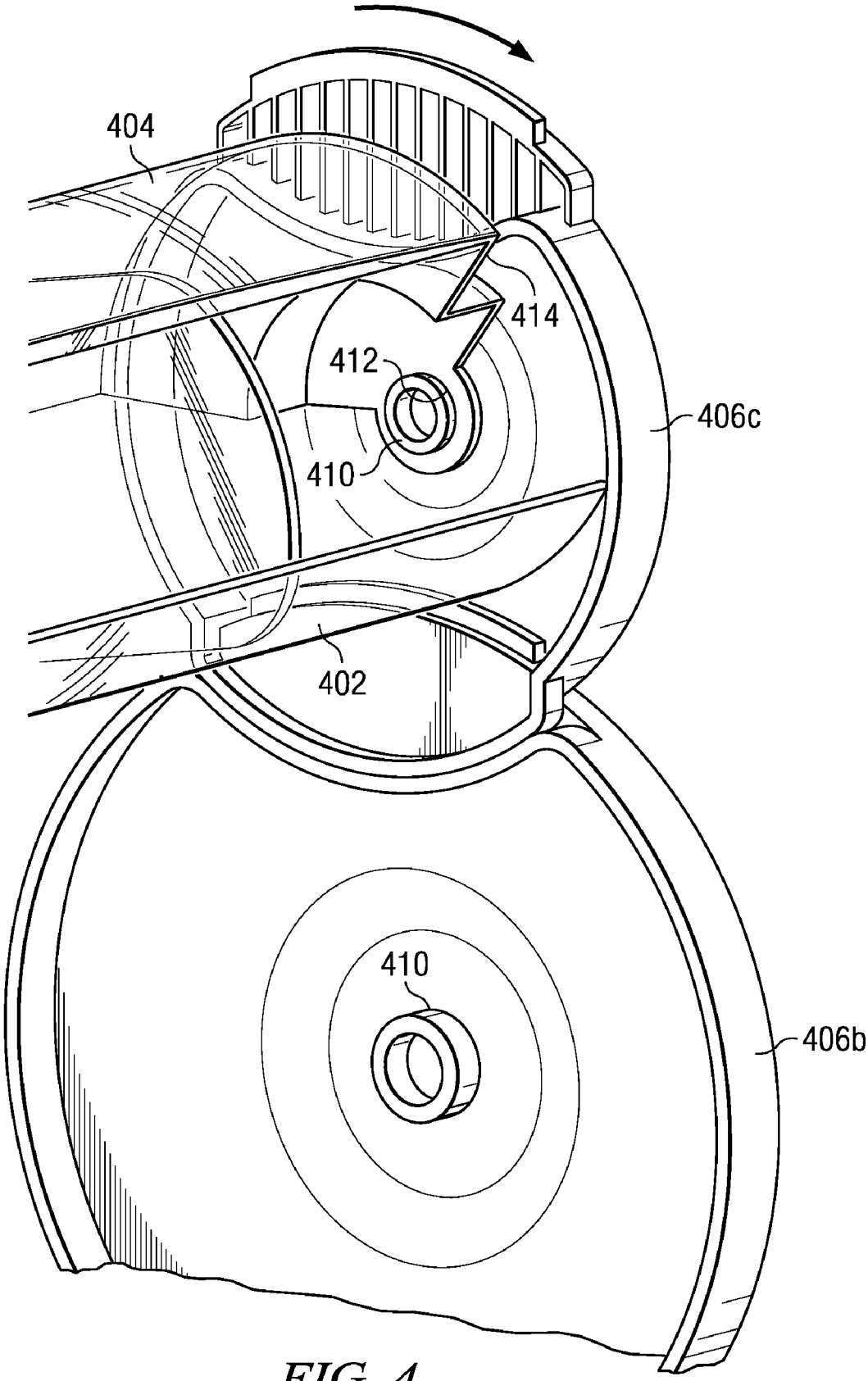
FIG. 4 illustrates tile rotatable door of one embodiment of Applicants' invention.

Referring to FIG. 4, a lower end cap 406*b* and upper end cap 406*c* are shown connected or mated as described by the preferred means illustrated in FIGS. 3*a* and 3*b*. Also shown with relation to the upper end cap 406*c* is a portion of a half-pipe bottom 402, as well as a portion of a rotatable door 404. Again, shown in the center of each end cap 406*b*, 406*c* is a hinge post 410. Illustrated in relation to the upper end cap 406*c* is the opening 412 of the integral hinge 414 of the rotatable door 404 fitted or installed on the hinge post 410. The material used in a preferred embodiment for the rotatable door 404 and its integral hinge portion 414 is slightly flexible so that the hinge portion 414 can snapped to fit over the hinge post 410. As shown by the arrow in FIG. 4, the rotatable door 404 when once so installed pivots about the hinge post 410 and can be rotated to an open or closed position in reference to the front or back of the display by physical manipulation of the door 404. In alternative embodiment the end caps 406*b*, 406*c* also comprise a semi-circular guide (not shown) centered on and above the hinge post 410. In this same alternative embodiment the rotatable door 404 further comprises a semi-circular receiving slot (not shown) that fits over the semi-circular guide, thus providing stability to the door as it rotates. This semi-circular guide can also have stops at either end, thus limiting the arc through which the rotatable door 404 can transit.

Figure 5A:
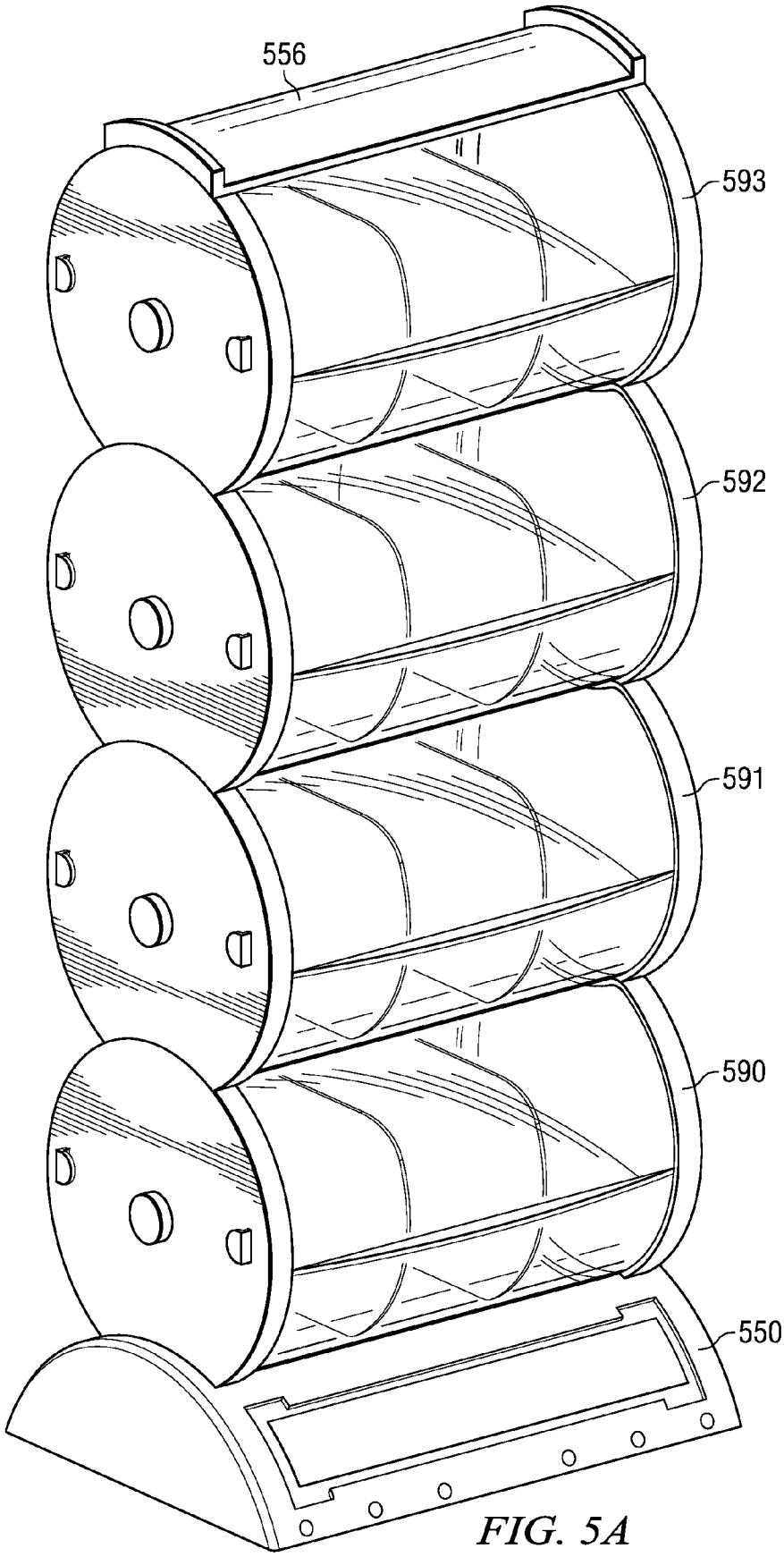
FIG. 5*a* illustrates a four-large bin configuration of Applicants' invention.
Figure 5B:
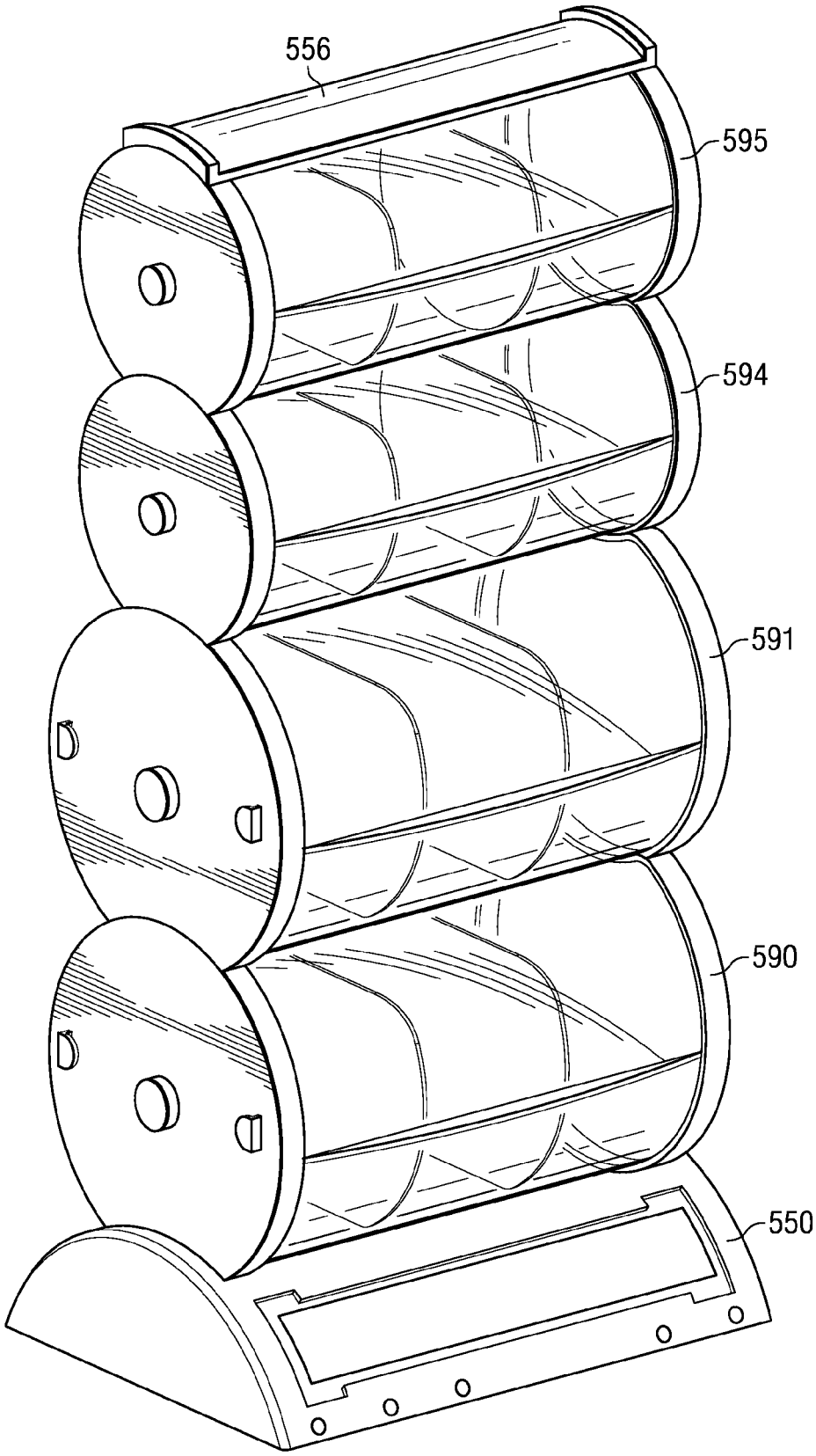
FIG. 5*b* illustrates a two-large bin and two-small bin configuration of Applicants' invention.
Figure 5C:
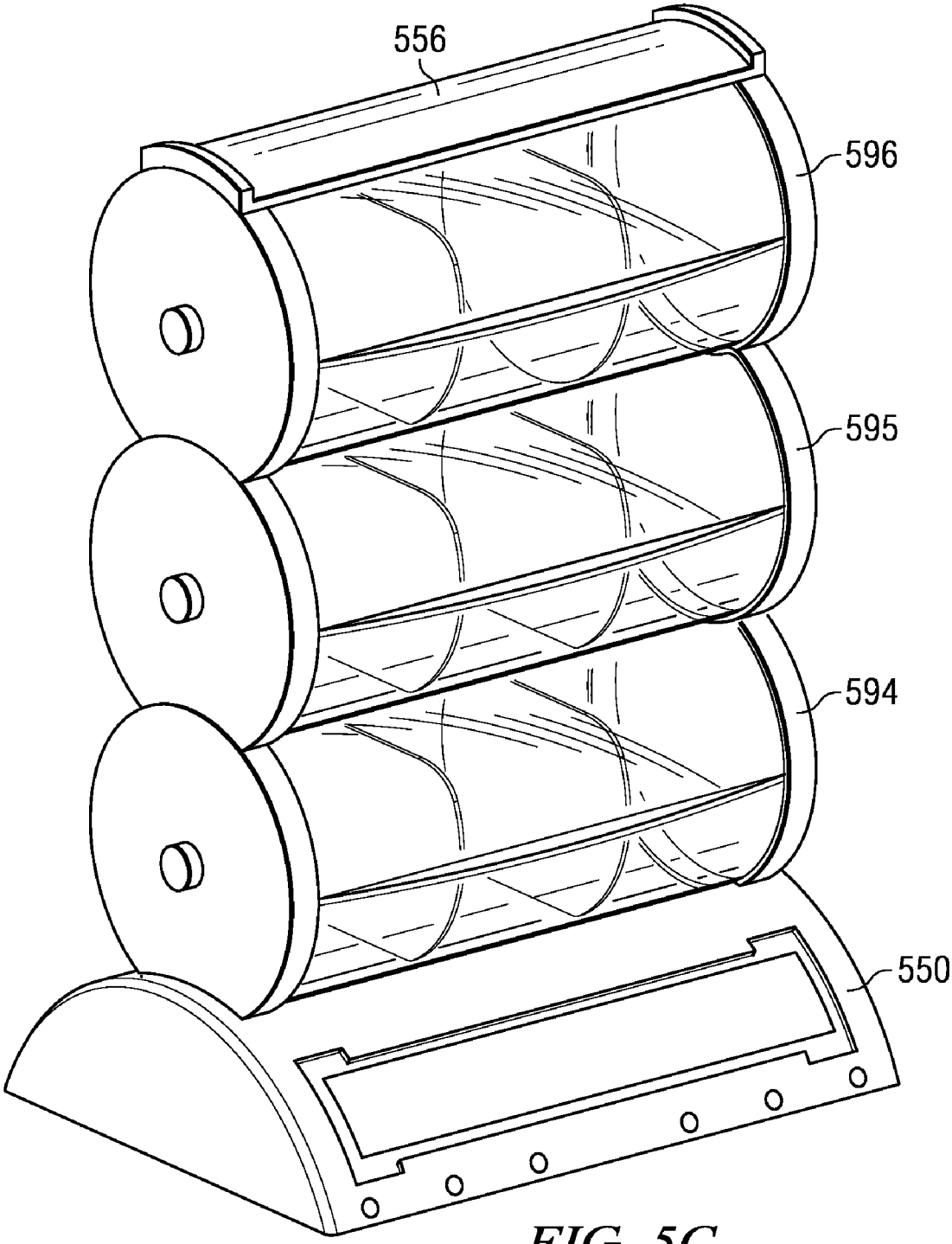
FIG. 5*c* illustrates a three-small bin configuration of Applicants' invention.

It should be understood that Applicants' invention allows for the vertical stacking of many different combinations of bins and bin arrangements. Some of these arrangements are shown in FIGS. 5*a*, 5*b*, and 5*c*. In these figures, the bins are shown as assembled units stacked vertically, all resting on a semi-circular base 550. The embodiment illustrated in FIG. 5*a* shows a first large bin 590, followed by a second large bin 591, followed by a third large bin 592, and finishing with a fourth large bin 593. FIG. 5*b* shows a mixture of large bins 590, 591 and small bins 594, 595 stacked in a vertical arrangement on top of the base 550. FIG. 5*c* shows an arrangement of three small bins 594, 595, 596 stacked on top of the base 550. All of these various display arrangements are topped by a cap 556 that can allow a header (not shown) mounting platform which is an optional feature.

The foregoing is merely illustrative of the principals of this invention, and various modifications can be made by those skilled in the art without departing from the scope and spirit of the invention. It should be understood, for example, that variations to the connecting features of the invention as well as the combination, shapes, and sizes of the various individual modules can be modified depending on the desired application of the display rack of Applicants' invention.

What is claimed is:

1. A display rack comprising:

At least two cylindrical display bins oriented horizontally and stacked vertically;

wherein said cylindrical display bins have:

a half-pipe bottom;

circular end caps at each horizontal end of each bin;

and the cylindrical bins are interconnected at their respective circular end caps when stacked vertically;

wherein each at least two cylindrical display bins comprise a rotatable door hinged at the end caps; and wherein when one of said rotatable doors is closed in the front of one display bin, the rear of the same display bin is open.

2. The display rack of claim 1 wherein said display rack comprises at least three cylindrical display bins.

3. The display rack of claim 1 further wherein each at least two cylindrical display bins comprise transparent half-pipe bottoms and transparent rotatable doors.

4. A display bin for a modular display rack, said display bin comprising:

a half-pipe bottom oriented horizontally having two ends;

two circular, vertically-oriented end caps, one each attached to each end of said half-pipe bottom; and a rotatable door hinged at its ends at the center of the circular end caps;

wherein when said rotatable door is closed in the front of said display bin, the rear of the display bin is open.

5. The display bin of claim 4 wherein said circular end caps comprise a receiving slot and an alignment tab, wherein said alignment tab is receivable in a receiving slot of a second display bin when said display bin and the second display bin are modularly stacked.

6. The display bin of claim 4 wherein said half-pipe bottom is transparent.

7. The display rack of claim 1 wherein at least one of said at least two cylindrical display bins is loadable from the front and the rear.

8. The display rack of claim 1 wherein said display rack further comprises retail consumer goods.

9. The display rack of claim 8 wherein said retail consumer goods are loadable from the front or rear of said at least two cylindrical display bins.

10. The display bin of claim 4 wherein said rotatable door comprises a radius which is approximately the same as the radius of said half-pipe bottom.

11. The display rack of claim 1 wherein each of said at least two cylindrical display bins comprise a half-pipe bottom, and wherein each of said rotatable doors comprise a radius which is approximately the same as the radius of the associated half-pipe bottom.

12. The display rack of claim 1 wherein said display rack is a retail display rack.

13. The display rack of claim 1 wherein each of said at least two cylindrical display bins comprise a concave shelf, wherein each of said at least two cylindrical display bins further comprise an inner convex rail, wherein at least one inner convex rail mates with at least one concave shelf.

14. The display rack of claim 13 wherein said inner convex rail is located at the bottom of each of said circular end caps, and wherein said concave shelf is located at the top of each of said circular end caps.

15. The display rack of claim 13 wherein each circular end cap further comprises an outer convex rail.

16. The display rack of claim 15 wherein each of said outer convex rails comprise at least one convex ridge, and wherein said convex ridge is vertically oriented.

17. A display rack comprising:

at least two cylindrical display bins oriented horizontally and stacked vertically;

wherein said cylindrical display bins have:

a half-pipe bottom;

circular end caps at each horizontal end of each bin;

and the cylindrical bins are interconnected at their respective circular end caps when stacked vertically; wherein each of said at least two cylindrical display bins comprise a concave shelf, wherein each of said at least two cylindrical display bins further comprise an inner convex rail, wherein at least one inner convex rail mates with at least one concave shelf, wherein said inner convex rail is located at the bottom of each of said circular end caps, and wherein said concave shelf is located at the top of each of said circular end caps.

* * * * *